US006711467B2

(12) United States Patent
Inoue et al.

(10) Patent No.: US 6,711,467 B2
(45) Date of Patent: Mar. 23, 2004

(54) ROBOT APPARATUS AND ITS CONTROL METHOD

(75) Inventors: Makoto Inoue, Kanagawa (JP); Tatsunori Kato, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/148,758

(22) PCT Filed: Oct. 5, 2001

(86) PCT No.: PCT/JP01/08808

§ 371 (c)(1),
(2), (4) Date: Jun. 3, 2002

(87) PCT Pub. No.: WO02/28603

PCT Pub. Date: Apr. 11, 2002

(65) Prior Publication Data

US 2003/0014159 A1 Jan. 16, 2003

(30) Foreign Application Priority Data

Oct. 5, 2000 (JP) ..... 2000-311735

(51) Int. Cl.[7] ..... G06F 19/00

(52) U.S. Cl. ..... 700/245; 700/248; 700/258; 700/259; 318/568.1; 901/1; 704/207; 706/11

(58) Field of Search ..... 700/245, 17, 61, 700/214, 231, 31, 248, 258, 259; 318/568.1, 568.11, 568.12, 568.2, 565; 901/1, 15, 47; 704/207, 209, 270, 275; 706/11, 16, 20, 23; 348/121

(56) References Cited

U.S. PATENT DOCUMENTS

| | | | | | |
|---|---|---|---|---|---|
| 5,063,492 | A | * | 11/1991 | Yoda et al. | 700/61 |
| 5,526,259 | A | * | 6/1996 | Kaji | 704/3 |
| 5,802,488 | A | | 9/1998 | Edatsune | 704/231 |
| 6,445,978 | B1 | * | 9/2002 | Takamura et al. | 700/245 |
| 2002/0103576 | A1 | * | 8/2002 | Takamura et al. | 700/245 |
| 2002/0137425 | A1 | * | 9/2002 | Furumura | 446/175 |
| 2002/0138822 | A1 | * | 9/2002 | Noma | 717/131 |

FOREIGN PATENT DOCUMENTS

| | | |
|---|---|---|
| CN | 1142647 A | 2/1997 |
| CN | 1291112 A | 4/2001 |
| CN | 1293606 | 5/2001 |
| EP | 0 730 261 | 9/1996 |
| EP | 1 072 297 | 1/2001 |
| JP | 8-297498 | 11/1996 |
| JP | 9-313743 | 12/1997 |
| JP | 11-212442 | 8/1999 |
| JP | 2000-187435 | 7/2000 |
| JP | 2000-210886 | 8/2000 |
| WO | WO 00/38808 | 7/2000 |
| WO | WO 00/43168 | 7/2000 |

OTHER PUBLICATIONS

Breazeal et al., Infant–like social interactions between a robot and a human caregiver, 1998, Internet, p. 1–p. 44.*

Chikama, Masaki and Takeda, Hideaki, "An Emotion Model and Simulator based on Embodiment and Interaction for Human Friendly Robots" Jinkou Chinou Gakkai Dai 47kai Chishiki Base System Kenkyuu–kai Shiryou, Mar. 27, 2000, pp. 13–18.

* cited by examiner

*Primary Examiner*—William A. Cuchlinski, Jr.
*Assistant Examiner*—McDieunel Marc
(74) *Attorney, Agent, or Firm*—Frommer Lawrence & Haug LLP; William S. Frommer; Dennis M. Smid

(57) ABSTRACT

At first, a history of user use is stored and a next action is determined based on the history of use. Secondly, behavior of a robot apparatus is determined based on a cycle parameter which allows behavior of the robot apparatus to have a cyclic tendency for each prescribed time period and each part of the robot apparatus is driven based on the determined behavior, and thirdly, an external stimulus detected by a prescribed external stimulus detecting device is evaluated to judge whether it was a spur from a user, and the external stimulus is converted into prescribed numerical parameter for each spur by a user and behavior is determined based on the parameter, so as to drive each part of the robot apparatus based on the determined behavior.

30 Claims, 11 Drawing Sheets

| | | INPUT EVENT NAME | DATA NAME | DATA RANGE | TRANSITION PROBABILITY TO ANOTHER NODE | | | | |
|---|---|---|---|---|---|---|---|---|---|
| TRANSITION DESIGNATION | node 100 | | | | A | B | C | D | n |
| | | | | | node 120 | node120 | node 1000 | | node 600 |
| OUTPUT BEHAVIOR | | | | | ACTION 1 | ACTION 2 | MOVE BACK | | ACTION 4 |
| | 1 | BALL | SIZE | 0, 1000 | 30% | | | | |
| | 2 | PAT | | | | 40% | | | |
| | 3 | HIT | | | | 20% | | | |
| | 4 | MOTION | | | | | 50% | | |
| | 5 | OBSTACLE | DISTANCE | 0, 100 | | | 100% | | |
| | 6 | | JOY | 50, 100 | | | | | |
| | 7 | | SUPRISE | 50, 100 | | | | | |
| | 8 | | SADNESS | 50, 100 | | | | | |
| | | | | | | | | | |

50

FIG. 7

ROBOT APPARATUS AND ITS CONTROL METHOD

TECHNICAL FIELD

The present invention relates to a robot apparatus and control method for the same, and more particularly, is suitably applied to a pet robot.

BACKGROUND ART

In recent years, a walking type pet robot with four legs which acts according to commands from a user and the surrounding environments has been proposed and developed by the assignee of this invention. Such pet robot looks like a dog or a cat which is kept in a general house and autonomously acts according to commands from a user and the surrounding environments. It should be noted that the word "behavior" is used for indicating a group of actions hereinafter.

If such pet robot has a function of adapting the life rhythm of the pet robot to the life rhythm of a user, the pet robot can be considered to have a further improved amusement property and as a result, the user will get a larger sense of affinity and satisfaction.

DESCRIPTION OF THE INVENTION

The present invention is made in view of the above points and intends to a robot apparatus and a control method for the same which can offer an improved amusement property.

The foregoing object and other objects of the invention have been achieved by the provision of a robot apparatus and a control method for the same, in which a history of user use is created in a temporal axis direction and is stored in a storage means and next behavior is determined based on the history of use. As a result, in the robot apparatus and control method for the same, life rhythm of the robot apparatus can be adapted to the life rhythm of the user, thus making it possible to realize a robot apparatus having a further improved entertainment property and a control method for the same so that a user can get a larger sense of affinity out of the robot.

Further, in the robot apparatus and control method for the same of the present invention, behavior of the robot apparatus is determined based on a cycle parameters which allows behavior of the robot apparatus to have a cyclic tendency for each prescribed time period, and each part of the robot apparatus is driven based on the determined behavior. As a result, in the robot apparatus and control method for the same, the life rhythm of the robot apparatus can be adapted to the life rhythm of the user, thus making it possible to realize a robot apparatus having a further improved entertainment property and a control method for the same so that a user can get a larger sense of affinity.

Furthermore, in the robot apparatus and control method for the same of the present invention, an external stimulus which is detected by a prescribed external stimulus detecting means is evaluated to judge whether the stimulus was from a user, the external stimulus from the user is converted into a predetermined numerical parameter and behavior is determined based on the parameter, and then each part of the robot apparatus is driven based on the determined behavior. As a result, in the robot apparatus and control method for the same, the life rhythm of the robot apparatus can be adapted to the life rhythm of the user, thus making it possible to realize a robot apparatus having a further improved entertainment property and a control method for the same so that a user can get a larger sense of affinity.

BRIEF DESCRIPTION OF THE DRAWINGS

FIG. 7 is a concept diagram showing a table of state transitions.

BEST MODE FOR CARRYING OUT THE INVENTION

Figure 1:
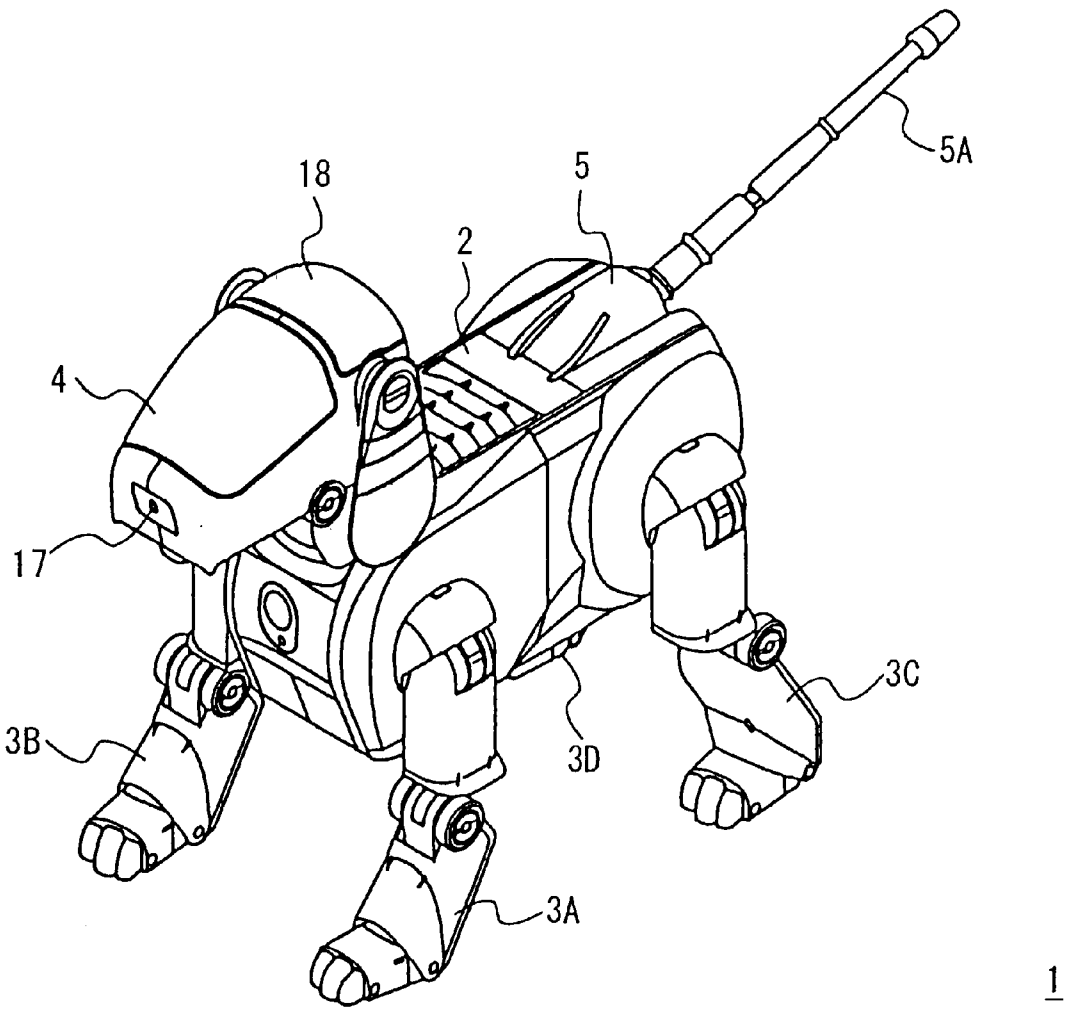
FIG. 1 is a perspective view showing an external structure of a pet robot to which the present invention is applied.

Preferred embodiments of this invention will be described with reference to the accompanying drawings:

Referring to FIG. 1, reference numeral 1 shows a pet robot in which leg units 3A to 3D are attached to the front, rear, left, and right of a body unit 2 and a head unit 4 and a tail unit 5 is attached to the front end and the rear end of the body unit 2.

Figure 2:
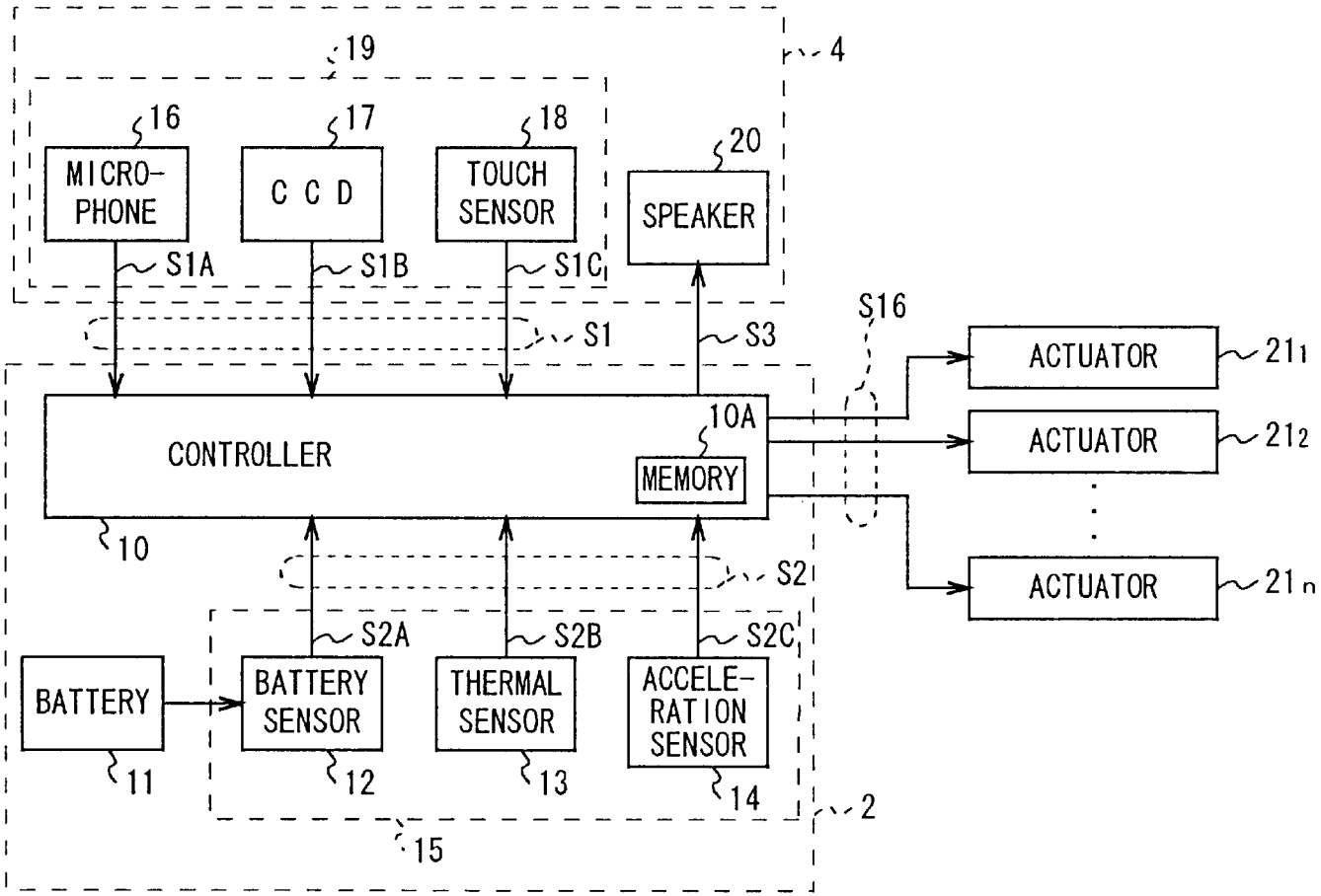
FIG. 2 is a block diagram showing a circuit arrangement of the pet robot.

In this case, the body unit 2 contains a controller 10 for controlling whole motions of the pet robot 1, a battery 11 serving as a power source of the pet robot 1, and an internal sensor section 15 composed of a battery sensor 12, a thermal sensor 13 and an acceleration sensor 14 as shown in FIG. 2.

The head unit 4 is provided with an external sensor section 19 composed of a microphone 16 which is for "ears" of the pet robot 1, a CCD (Charge Coupled Device) camera 17 which is for "eyes" and a touch sensor 18, a speaker 20 which is for "mouth" and so on, at fixed positions.

Further, actuators $\mathbf{21}_1$ to $\mathbf{21}_n$ are installed in the joints of the leg units 3A to 3D, the jointing parts of the leg units 3A to 3D and the body unit 2, the jointing part of the head unit 4 and the body unit 2, and the jointing part of the tail unit 5 and the body unit 2.

The microphone 16 of the external sensor section 19 receives a command sound indicating "walk", "lie down", or "chase a ball" which is given from a user by scales via a sound commander not shown, and transmits the obtained audio signal S1A to the controller 10. Further, the CCD camera 17 takes a photo of surrounding conditions and sends the obtained video signal S1B to the controller 10.

Further, the touch sensor 18 is provided on the top of the head unit 4 as can be seen from FIG. 1, to detect pressure which is generated by a user's physical spur such as "stroking" or "hit" and then transmits the detection result as a pressure detection signal S1C to the controller 10.

The battery sensor 12 of the internal sensor section 15 detects the energy level of the battery 11 and transmits the detection result as a battery level detection signal S2A to the controller 10. The thermal sensor 13 detects an internal temperature of the pet robot 1 and transmits the detection result as a temperature detection signal S2B to the controller 10. The acceleration sensor 14 detects accelerations in three axis directions (Z axis direction, Y axis direction and Z axis direction) and transmits the detection result as an acceleration detection signal S2C to the controller 10.

The controller 10 judges the external and internal states, commands from a user and the existence of a spur from a user, based on the audio signal S1A, video signal S1B and pressure detection signal S1C (hereinafter, they are referred to as an external information signal S1 altogether) given from the external sensor section 19, the battery level signal S2A, temperature detection signal S2B and acceleration detection signal S2C (hereinafter, they are referred to as an internal information signal S2 altogether) given from the internal sensor section 15.

Then, the controller 10 determines next behavior based on the judgement result and a control program which has been stored in the memory 10A in advance, and drives necessary actuators $\mathbf{21}_1$ to $\mathbf{21}_n$ based on the determination result, so as to make behavior or an action, for example, to move the head unit 4 up, down, right and left, to move a tail 5A of the tail unit 5, to move the leg units 3A to 3D for walking, or the like.

At this point, the controller 10 generates the audio signal S3, if necessary, and gives it to the speaker 20, so as to output sounds based on the audio signal S3 to outside or to blink LEDs (Light Emitting Diode), not shown, which are installed at the "eye" positions of the pet robot 1.

In this way, the pet robot 1 can autonomously behave according to the external and internal states, commands from a user, spurs from a user and the like.

In addition to the aforementioned operation, the pet robot 1 is arranged to change its behavior and actions according to a history of operation inputs such as spurs and commands with the sound commander from a user and a history of its own behavior and actions, as if a real animal grows.

Figure 3:
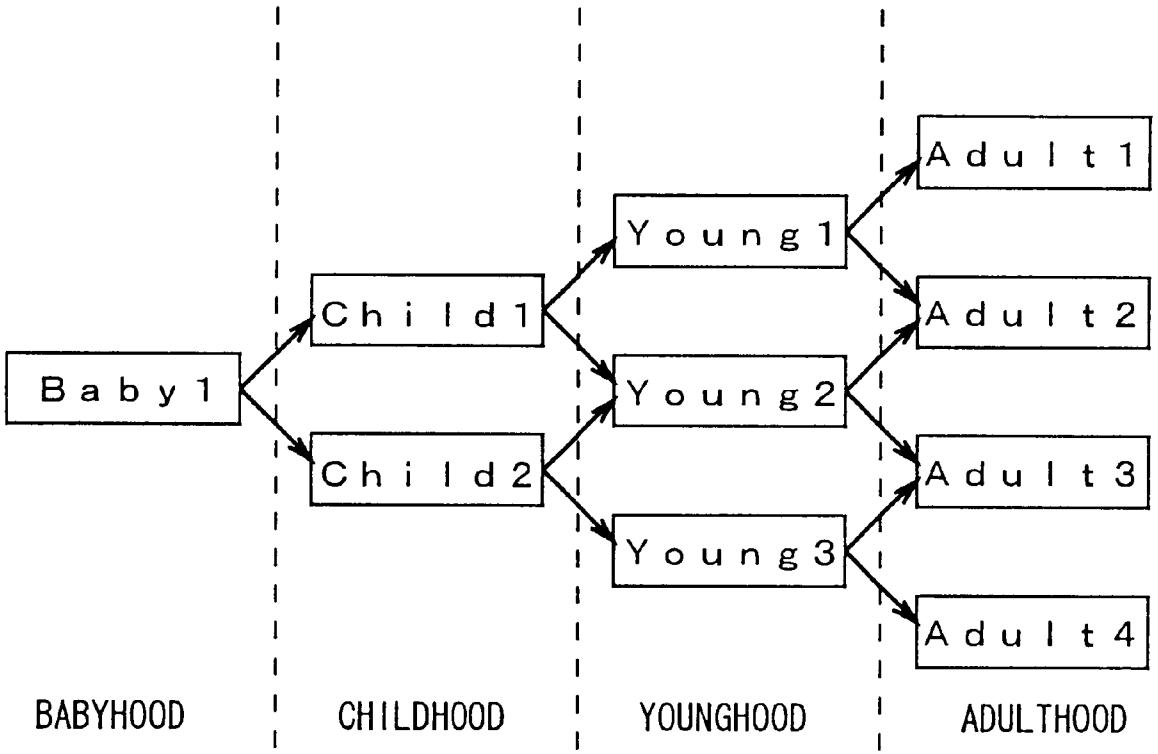
FIG. 3 is a concept diagram showing growth model.

That is, the pet robot 1 has four "growth steps" of "babyhood", "childhood", "younghood" and "adulthood" as a growth process as shown in FIG. 3. And the memory 10A of the controller 10 stores behavior and action models made up from various control parameters and control programs, as a basis of behavior and actions relating to "walking", "motion (motion)", "behavior" and "sound (sound)", for each "growth step".

Therefore, the pet robot 1 "grows" based on the four steps of "babyhood", "childhood", "younghood", and "adulthood", according to the histories of inputs from outside and of its own behavior and actions.

Note that, as known from FIG. 3, this embodiment provides a plurality of behavior and action models for each of "growth steps" of "childhood", "younghood" and "adulthood".

Thus, the pet robot 1 can change "behavior" with "growth", according to the history of inputs of spur and commands from a user and the history of its own behavior and actions, as if a real animal makes his behavior according to how to be raised by his owner.

(2) Processing by Controller 2

Next specific processing by a controller 10 in the pet robot 1 will be explained.

Figure 4:
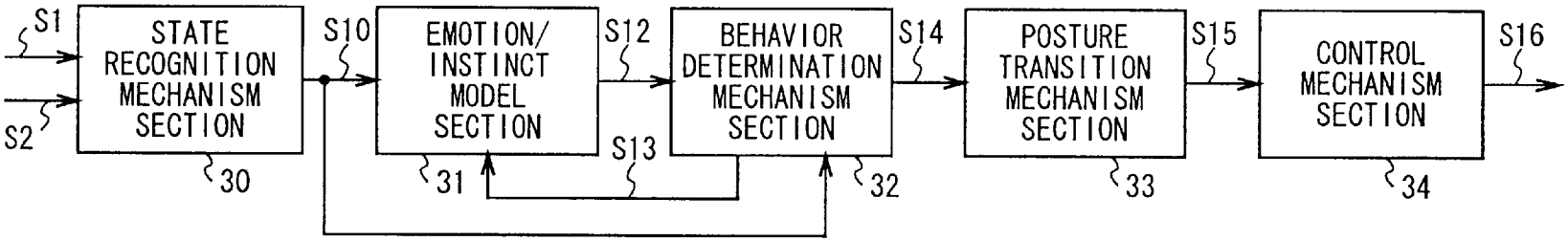
FIG. 4 is a block diagram explaining controller's processing.

As shown in FIG. 4, the contents of processing by the controller 2 are functionally divided into five sections: a state recognition mechanism section 30 for recognizing the external and internal states; a emotion/instinct model section 31 for determining the state of emotion and instinct based on the recognition result obtained by the state recognition mechanism section 30; a behavior determination mechanism section 32 for determining next behavior and action based on the recognition result obtained by the state recognition mechanism section 30 and the output of the emotion/instinct model section 31; a posture transition mechanism section 33 for making a motion plan as to how to make the pet robot 1 to perform the behavior and action determined by the action determination mechanism section 32; and a device control mechanism section 34 for controlling the actuators $\mathbf{21}_1$ to $\mathbf{21}_n$ based on the motion plan made by the posture transition mechanism section 33.

Hereinafter, the state recognition mechanism section 30, the emotion/instinct model section 31, the behavior determination mechanism section 32, the posture transition mechanism section 33, the device control mechanism section 34 and the growth control mechanism section 35 will be explained.

(2-1) Operation of State Recognition Mechanism Section 30

The state recognition mechanism section 30 recognizes the specific state based on the external information signal S1 given from the external sensor section 19 (FIG. 2) and the internal information signal S2 given from the internal sensor section 15, and gives the emotion/instinct model section 31 and the behavior determination mechanism section 32 the recognition result as state recognition information S10.

In actual, the state recognition mechanism section 30 always checks the audio signal S1A which is given from the microphone 16 (FIG. 2) of the external sensor section 19, and when detecting that the spectrum of the audio signal S1A has the same scales as a command sound which is outputted from the sound commander for a command such as "walk", "lie down" or "chase a ball", recognizes that the command has been given, and gives the recognition result to the emotion/instinct model section 31 and the behavior detection mechanism section 32.

Further, the state recognition mechanism section 30 always checks the video signal S1B which is given from the CCD camera 17 (FIG. 2), and when detecting "something red" or "a plane which is perpendicular to the ground and is higher than a prescribed height" in the picture based on the video signal S1B, recognizes that "there is a ball" or "there is a wall", and then gives the recognition result to the emotion/instinct model section 31 and the behavior determination mechanism section 32.

Furthermore, the state recognition mechanism section 30 always checks the pressure detection signal S1C which is given from the touch sensor 18 (FIG. 2), and when detecting pressure having a higher value than a predetermined threshold value, for a short time (less than two seconds, for example), based on the pressure detection signal S1C, recognizes that "it was hit (scold)", and on the other hand, when detecting pressure having a lower value than a predetermined threshold, for a long time (two seconds or more, for example), recognizes that "it was stroked (praised)". Then, the state recognition mechanism section 30 gives the recognition result to the emotion/instinct model section 31 and the behavior determination mechanism section 32.

Furthermore, the state recognition mechanism section 30 always checks the acceleration detection signal S2C which is given from the acceleration sensor 14 (FIG. 2) of the internal sensor section 15, and when detecting the acceleration having a higher level than a preset predetermined level, based on the acceleration signal S2C, recognizes that "it received a big shock", or when detecting the bigger acceleration like acceleration by gravitation, recognizes that "it fell down (from a desk or the like)". And then the state recognition mechanism section 30 gives the recognition result to the emotion/instinct model 31 and the behavior determination mechanism section 32.

Furthermore, the state recognition mechanism section 30 always checks the temperature detection signal S2B which is given from the thermal sensor 13 (FIG. 2), and when detecting a temperature higher than a predetermined level, based on the temperature detection signal S2B, recognizes that "the internal temperature has increased" and then gives the recognition result to the emotion/instinct model section 31 and the behavior determination mechanism section 32.

(2-2) Operation by Feeling/Instinct Model Section 31

Figure 5:
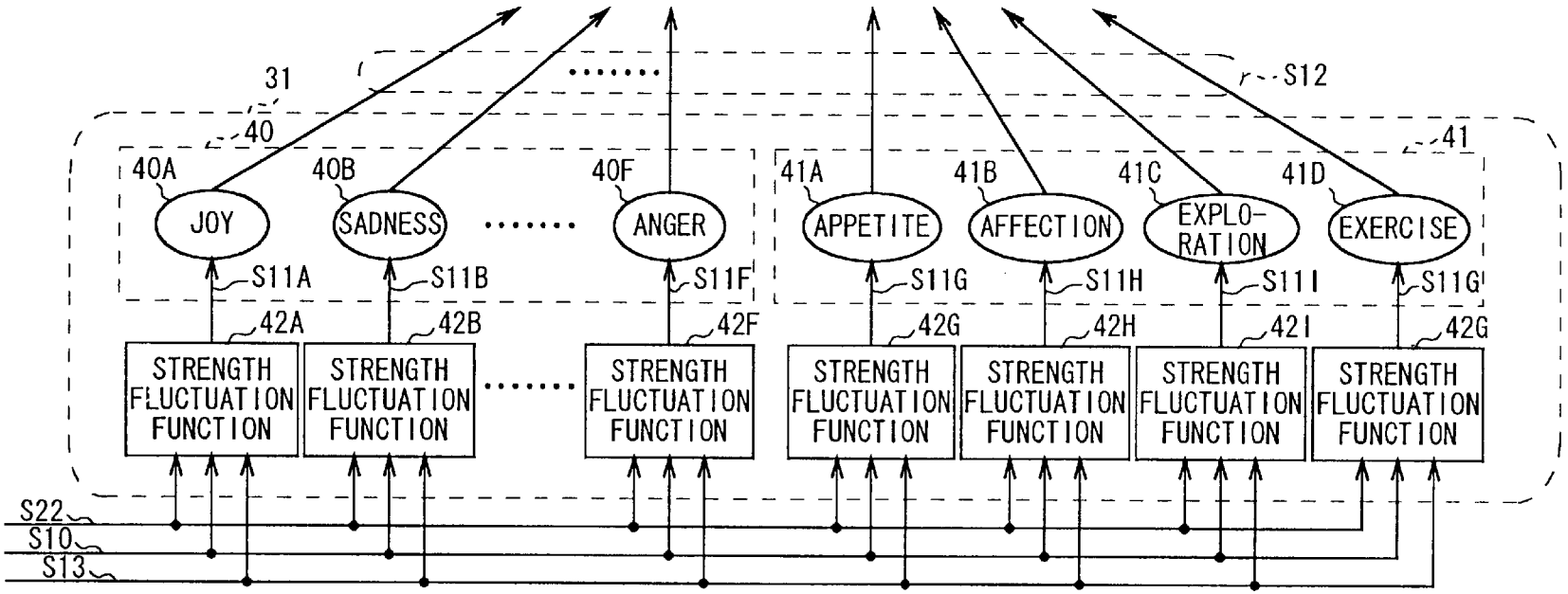
FIG. 5 is a concept diagram explaining data processing in a emotion/instinct model section.

The emotion/instinct model section 31, as shown in FIG. 5, has a group of basic emotions composed of emotional units 40A to 40F as emotion models corresponding to six emotions of "joy", "sadness", "surprise", "horror", "hate" and "anger", a group of basic desires 41 composed of desire units 41A to 41D as desire models corresponding to four desires of "appetite", "affection", "exploration" and "exercise", and strength fluctuation functions 42A to 42H corresponding to the emotional units 40A to 40F and desire units 41A to 41D.

For example, each emotional unit 40A to 40F expresses the strength of the corresponding emotion by its strength ranging from level 0 to 100, and changes the strength based on the strength information A11A to A11F which is given from the corresponding strength fluctuation function 42A to 42F, time to time.

Similarly to the emotional units 40A to 40F, each desire unit 41A to 41D expresses the strength of the corresponding desire by a level ranging from 0 to 100, and changes the strength based on the strength information S12G to S12F which is given from the corresponding strength fluctuation function 42G to 42K, time to time.

Then, the emotion/instinct model section 31 determines the emotion by combining the strengths of these emotional units 40A to 40F, and also determines the instinct by combining the strengths of these desire units 41A to 41D and then outputs the determined emotion and instinct state to the behavior determination mechanism section 32 as emotion/instinct state information S12.

Note that, the strength fluctuation functions 42A to 42G are functions to generate and output the strength information S11A to A11G for increasing or decreasing the strengths of the emotional units 40A to 40F and the desire units 41A to 41D according to the preset parameters as described above, based on the state recognition information S10 which is given from the state recognition mechanism section 30 and the behavior information S13 indicating the current or past behavior of the pet robot 1 himself which is given from the behavior determination mechanism section 32 which will be described later.

Under this operation, the pet robot 1 can have his characters such as "aggressive" or "shy" by setting the parameters of these strength fluctuation functions 42A to 42G to different values for each behavior and action model (Baby 1, Child 1, Child 2, Young 1 to Young 3, Adult 1 to Adult 4).

(2-3) Operation of Behavior Determination Mechanism Section 32

The behavior determination mechanism section 32 has a plurality of behavior models for each behavior and action model (Baby 1, Child 1, Child 2, Young 1 to Young 3, and Adult 1 to Adult 4) in a memory 10A.

Based on the state recognition information S10 given from the state recognition mechanism section 30, the strengths of the emotional units 40A to 40F and desire units 41A to 41D of the emotion/instinct model section 31, and corresponding behavior models, the behavior determination mechanism section 32 determines next behavior and action, and outputs the determination result as behavior determination information S14 to the posture transition mechanism section 33.

Figure 6:
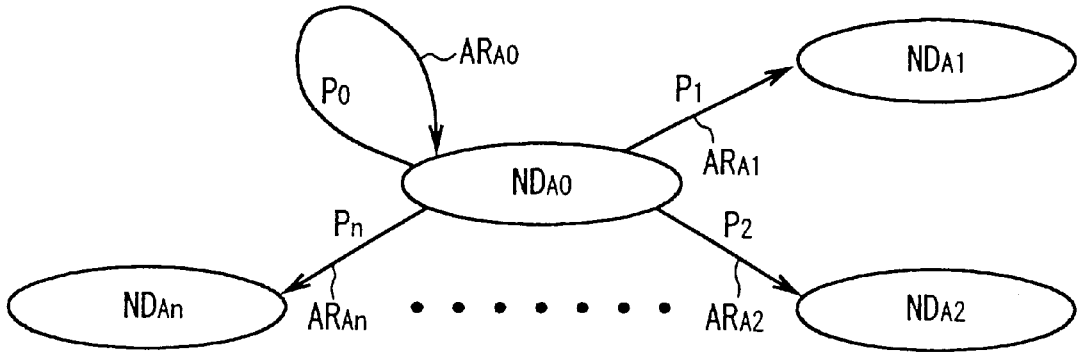
FIG. 6 is a concept diagram showing probability automatons.

At this point, as a technique of determining next behavior and action, the behavior determination mechanism section 32 uses an algorithm called a probability automaton which is to probability determine that transition is made from one node (state) $ND_{A0}$ to which node $ND_{A0}$ to $ND_{An}$, the same or another, based on transition probability $P_0$ to $P_n$ set for arcs $AR_{A0}$ to $AR_{An}$ connecting between the nodes $ND_{A0}$ to $ND_{An}$, as shown in FIG. 6.

More specifically, the memory 10A has stored a state transition table 50 as shown in FIG. 7 as behavior models for each node $ND_{A0}$ to $ND_{An}$, so that the behavior determination mechanism section 32 determines next behavior and action based on this state transition table 50.

In this state transition table 50, input events (recognition results) which are conditions for transition from a node $ND_{A0}$ to $ND_{An}$ are shown in a priority order in a line of "input event name" and further conditions for the transition conditions are shown in the same rows of the lines of "data name" and "data range".

With respect to the node $ND_{100}$ defined in the state transition table 50 of FIG. 7, in the case where the recognition result of "detect a ball" is obtained, or in the case where the recognition result of "detect an obstacle" is obtained, a condition to make a transition to another node is that the "size" of the ball which is information given together with the recognition result is "between 0 to 1000 (0, 1000)", or that the "distance" to the obstacle which is information given together with the recognition result is "between 0 to 100 (0, 100)".

In addition, if there is no recognition result input, transition can be made from this node $ND_{100}$ to another node when the strength of any emotional unit 40A to 40F out of the "joy", "surprise" or "sadness" is "between 50 and 100 (50, 100), out of the strengths of the emotional units 40A to 40F and the desire units 41A to 41D which are periodically checked by the behavior determination mechanism section 32.

In addition, in the state transition table 50, the names of nodes to which a transition can be made from the node $ND_{A0}$ to $ND_{An}$ are shown in a row of a "transition destination node" in a column of "transition probability to another node", and transition probability to another node $ND_{A0}$ to $ND_{An}$ at which transition can be made when the conditions shown in the "input event name", "data name" and "data range" are all met, are shown in a row of "output behavior" in the column of "transition probability to another node". It should be noted that the sum of transition probability in each row in the column of "transition probability to another node" is 100%

Therefore, with respect to this example of node $NODE_{100}$, in the case where "a ball (BALL) is detected" and the recognition result indicating that the "size" of the ball is "between 0 to 1000 (0, 1000) is obtained, a transition can be made to "node $NODE_{120}$ (node 120)" at probability of "30%", and at this point, the behavior and action of "ACTION 1" are to be output.

Each behavior model is composed of the nodes $ND_{A0}$ to $ND_{An}$, which are shown by such state transition table 50, connected one to others.

As described above, the behavior determination mechanism section 32, when receiving the state recognition information S10 from the state recognition mechanism section 30, or when a predetermined time passes after the last action is performed, probably determines next behavior and action (behavior and action shown in the row of "output behavior") by referring to the state transition table 50 relating to the node $ND_{A0}$ to $ND_{An}$ corresponding to the corresponding behavior model stored in the memory 10A.

(2-4) Processing by Posture Transition Mechanism Section 33

The posture transition mechanism section 33, when receiving the behavior determination information S14 from the behavior determination mechanism section 32, makes a motion plan for a series of actions as to how to make the pet robot 1 perform the behavior and action based on the behavior determination information S14, and then gives the device control mechanism section 34 action order information S15 based on the motion plan.

Figure 8:
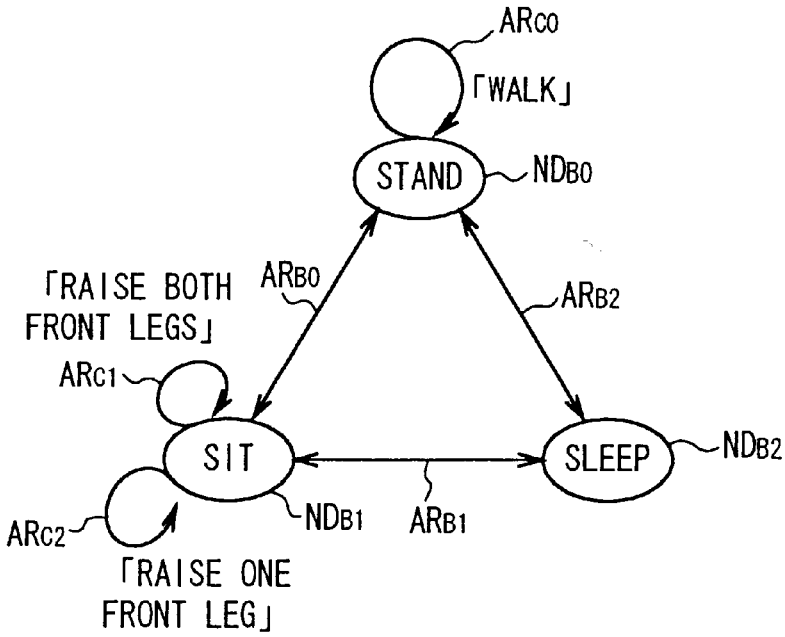
FIG. 8 is a concept diagram explaining a directed graph.

At this point, the posture transition mechanism section 33, as a technique to make a motion plan, uses a directed graph as shown in FIG. 8 where postures the pet robot 1 can take are taken to as nodes $ND_{B0}$ to $ND_{B2}$, the nodes $N_{B0}$ to $ND_{B2}$ between which the transition can be made are connected with directed arcs $AR_{B0}$ to $AR_{B2}$ indicating actions, and each action which can be performed while the action of a node $ND_{B0}$ to $ND_{B2}$ is performed is taken to as a self action arc $AR_{C0}$ to $AR_{C2}$.

(2-5) Processing by Device Control Mechanism Section 34

The device control mechanism section 34 generates a control signal S16 based on the action order information S15 which is given from the posture transition mechanism section 33, and drives and controls each actuators $\mathbf{21}_1$ to $\mathbf{21}_n$ based on the control signal S16, to make the pet robot 1 perform designated behavior and action.

(2-6) Awakening Level and Interaction Level

This pet robot 1 has a parameter called an awakening level indicating the awakening level of the pet robot 1 and a parameter called an interaction level indicating how often a user, an owner, made spurs, so as to adapt the life pattern of the pet robot 1 to the life pattern of the user.

The awakening level parameter is a parameter which allows the behavior and emotion of the robot or the tendency of behavior to be executed, to have a certain rhythm (cycle). For example, such tendency may be created that dull behavior is to be made in the morning when the awakening level is low and lively behavior is to be made in the evening when the awakening level is high. This rhythm corresponds to the biorhythm of human beings and animals.

In this description, the awakening level parameter is used but another word can be used such as a biorhythm parameter, as long as it is a parameter which occurs the same results. In this embodiment, the value of the awakening level parameter is increased when the robot starts. However, a fixed temporal fluctuation cycle may be preset for the awakening level parameter.

Figure 9:
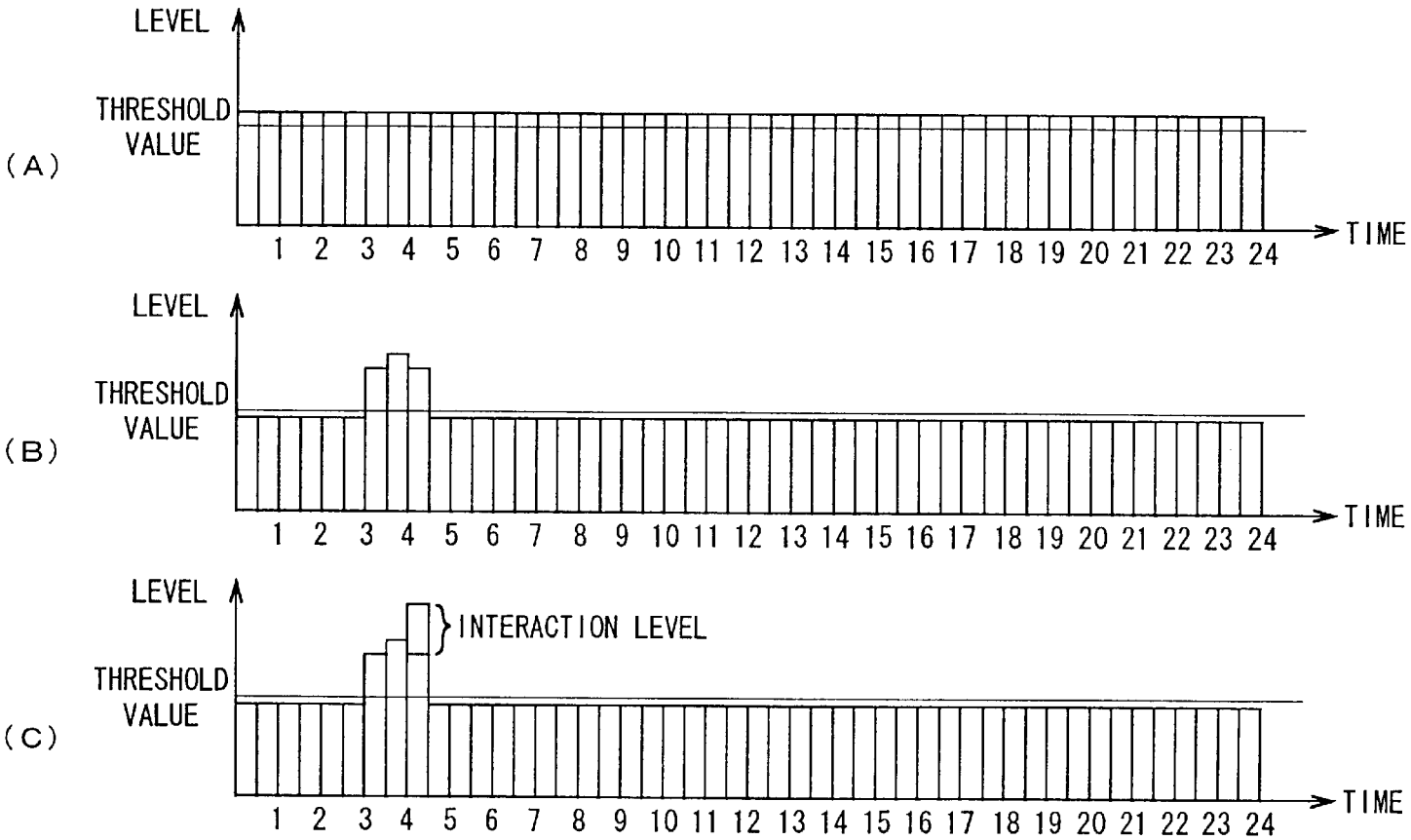
FIG. 9 shows schematic diagrams explaining awakening parameter tables.

With respect to this awakening level, 24 hours in a day are divided by a predetermined time period, 30 minutes for example, which is called a time slot, to divide the 24 hours into 48 time slots, an awakening level is expressed by a level ranging from 0 to 100 for each time slot and is stored in the memory 10A of the controller 10 as an awakening parameter table. In this awakening parameter table, the same awakening level is set to all time slots as an initial value as shown in FIG. 9(A).

When the user turns on the power of the pet robot 1 to drive under this state, the controller 10 increases the awakening levels of the time slot of time when the pet robot 1 starts and of the time slots around that time by predetermined levels, and at the same time, equally divides and decreases the total of the added awakening levels from the awakening levels of the other time slots, and then updates the awakening parameter table.

In this way, while the user repeatedly starts and uses the pet robot 1, the controller 10 regulates the total of awakening levels of time slots so as to create the awakening parameter table suitable for the life pattern of the user.

Figure 10:
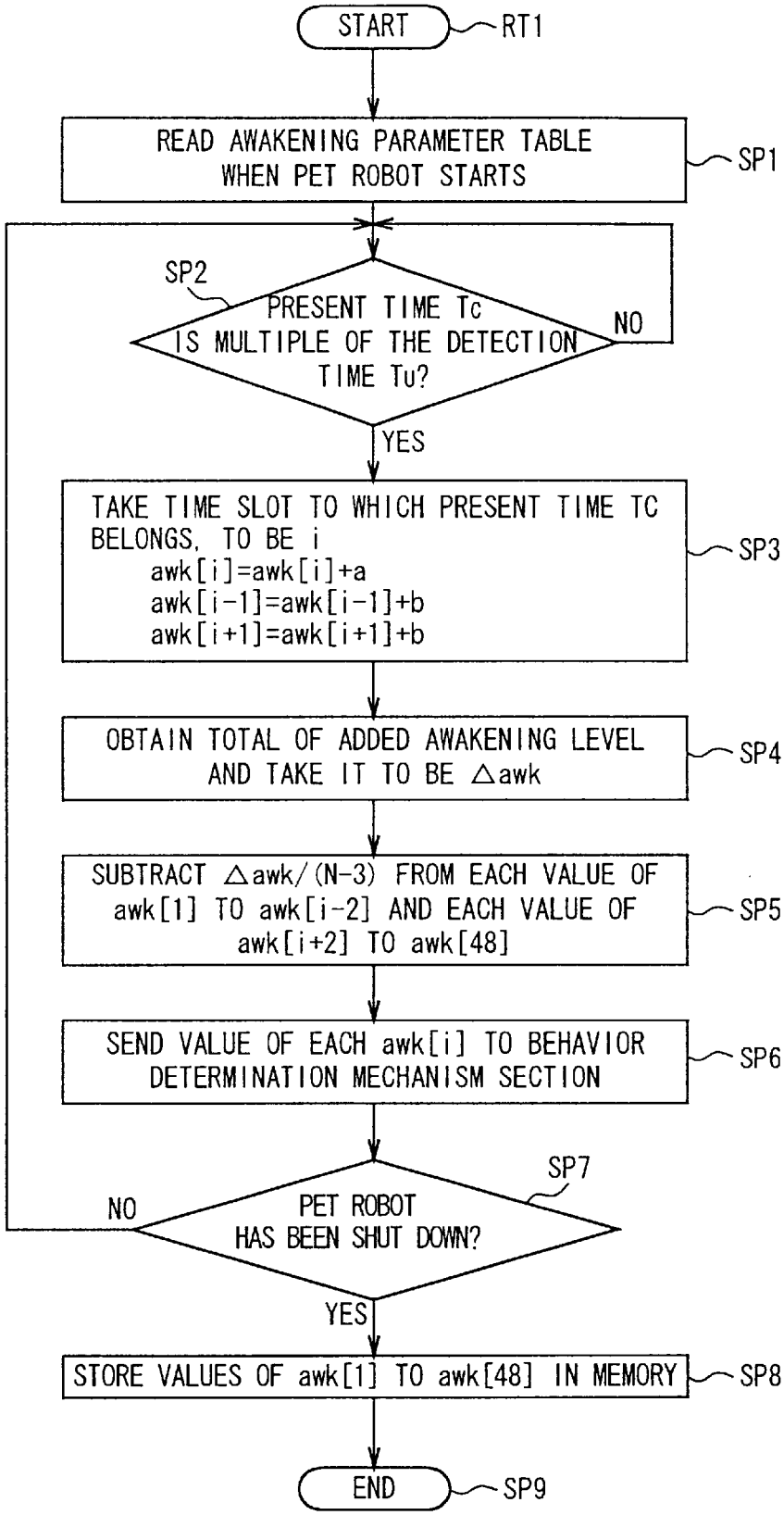
FIG. 10 is a flowchart showing a processing procedure of creating the awakening parameter table.

That is, when the user starts the pet robot 1 by turning its power on, the controller 10 executes an awakening parameter table creating processing procedure RT1 shown in FIG. 10. The state recognition mechanism section 30 of the controller 10 starts the awakening parameter table creating processing procedure RT1 of FIG. 10, and at step SP1, recognizes that the pet robot 1 has started, based on the internal information signal S2 given from the internal sensor section 15, and gives this recognition result as state recognition information S10 to the emotion/instinct model section 31 and the behavior determination mechanism section 32.

The emotion/instinct model section 31, when receiving the state recognition information S10, takes the awakening parameter table out of the memory 10A, moves to step 2 where it judges whether the current time Tc is multiple of the detection time Tu for detecting the drive state of the pet robot 1, and repeats the processing step SP2 until an affirmative result is obtained. The period between two successive detection times Tu has been selected so as to be much shorter than the time period of the time slot.

When an affirmative result is obtained at step SP2, this means that the detection time Tu for detecting the drive state of the pet robot 1 has just come, and in this case, the emotion/instinct model section 31 moves to step SP3 to add "a" levels (2 levels, for example) to the awakening level awk[i] of i-th time slot to which the current time Tc belongs, and also to add "b" levels (1 level, for example) to the awakening levels awk[i-1] and awk[i+1] of the time slots which exist before and after the i-th time slot.

However, if the addition result exceeds level 100, an awakening level awk is compulsory set to level 100. As described above, the emotion/instinct model section 31 adds a predetermined level to the awakening levels of time slots around the time when the pet robot 1 is active, thereby preventing the awakening level awk [i] of only one time slot from projecting and increasing.

Then, at step SP4, the emotion/instinct model 31 calculates the total (a+2b) of the added awakening levels awk as Δawk, and moves to following step SP5 where it subtracts Δawk/(N−3) from each of the levels starting with the awakening level awk[1] of the first time slot to the awakening level awk[i−2] of the (i−2)-th time slot and each of the levels starting with from the awakening level awk[i+2] of the (i+2)-th time slot to the awakening level awk[48] of the 48th time slot.

At this point, if a subtraction result is less than level 0, the awakening level awk is compulsory set to level 0. The emotion/instinct model section 31 equally divides and subtracts the total Δawk of the added awakening level from all awakening levels awk of the time slots other than the increased time slots, as described above, thereby keeping a balance of the awakening parameter table by regulating the total of the awakening levels awk in a day.

Then, at step SP6, the emotion/instinct model section 31 gives the behavior determination mechanism section 32 the awakening level awk of each time slot in the awakening parameter table, to reflect the value of each awakening level awk in the awakening parameter table on the behavior of the pet robot 1.

Specifically, when the awakening level awk is high, the emotion/instinct model section 31 does not greatly decrease the level of desire of the desire unit 41D of "exercise" even the pet robot 1 exercises very hard, and on the other hand, when the awakening level awk is low, the emotion/instinct model section 31 immediately decreases the level of desire of the desire unit 41D of "exercise" after little exercise, and in this way, it indirectly changes the activity based on the level of desire of the desire unit 41D of "exercise" according to the awakening level awk.

On the other hand, as to the selection of a node in the state transition table 50, the behavior determination mechanism section 32 increases the transition probability for making a transition to an active node when the awakening level awk is high, and decreases the transition probability for making a transition to an active node when the awakening level awk is low, thus it directly changes the activity according to the awakening level awk.

Therefore, when the awakening level awk is low, the behavior determination mechanism section 32 selects a node so as to express a sleepiness state through "yawn", "lie down" or "stretch", at high possibility in the state transition table 50, in order to directly express that the pet robot 1 is sleepy, to the user. If the awakening level awk given from the emotion/instinct mode section 31 is lower than a predetermined threshold value, the behavior determination mechanism section 32 shuts the pet robot 1 down.

Then the emotion/instinct model section 31 moves to following step SP7 to judge whether the pet robot 1 has been shut down, and then repeats the aforementioned steps SP2 to SP6 until an affirmative result is obtained.

When an affirmative result is obtained at step SP6, this means that the awakening level awk is lower than a predetermined threshold value (a lower value is selected than an initial value of the awakening level awk in this case) shown in FIGS. 9(A) and 9(B), or that the user turns the power off, then the emotion/instinct model section 31 moves to following step SP8 to store the values of the awakening level awk[1] to awk[48] in the memory 10A in order to update the awakening parameter table and then, moves to step SP9 where the processing procedure RT1 is terminated.

At this point, the controller 10 refers to the awakening parameter table stored in the memory 10A to detect time corresponding to a time slot of which the awakening level awk becomes larger than a threshold value and to perform various setting so as to restart the pet robot 1 at the detected time.

As described above, the pet robot 1 starts when the awakening level becomes higher than a predetermined threshold value and on the other hand, shuts down when the awakening level becomes lower than a predetermined threshold value, thereby the pet robot 1 can naturally wake and sleep according to the awakening level awk, thus making it possible to adapt the life pattern of the pert robot 1 to the life pattern of the user.

In addition, the pet robot 1 has a parameter called an interaction level indicating how often the user made spurs, and a time-passage-based averaging method is used as a method of obtaining this interaction level.

For the time-passage-based averaging method, inputs through user's spurs are selected out of inputs to the pet robot 1 at first, and then points which have been decided in correspondence with the kinds of spurs are stored in the memory 10A. That is, each spur from the user is converted into a numerical value which is stored in the memory 10A. In this pet robot 1, 15 points for "call name", 10 points for "stroke head", 5 points for "touch switch of head or the like", 2 points for "hit", and 2 points for "hold up" are set and stored in the memory 10A.

The emotion/instinct model section 31 of the controller 10 judges based on the state recognition information S10 given from the state recognition mechanism section 30 whether the user has made a spur. When it is judged that the user has made a spur, then the emotion/instinct model section 31 stores the number of points corresponding to the spur and time. Specifically, the emotion/instinct model section 31 sequentially stores 5 points at 13:05:30, 2 points at 13:05: 10 and 10 points at 13:08:30, and sequentially deletes data which has been stored for a fixed time (15 minutes, for example).

Figure 11:
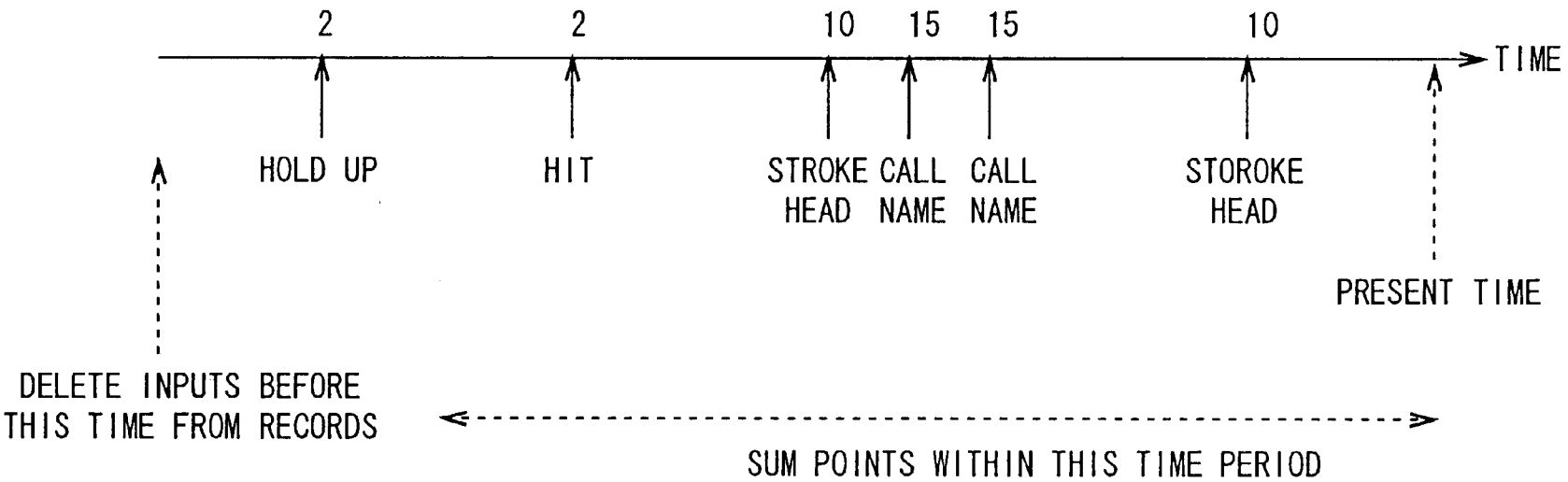
FIG. 11 is a schematic diagram explaining of obtaining an interaction level.

In this case, the emotion/instinct model section 31 previously sets a time period (10 minutes, for example) for calculating an interaction level, and calculates the total of points which exist from the set time period before the present time to the present time, as shown in FIG. 11. Then the emotion/instinct model section 31 normalizes the calculated points to be within a preset range and takes this normalized points to as the interaction level.

Then, as shown in FIG. 9C, the emotion/instinct model section 31 adds the interaction level to the awakening level of time slot corresponding to the time period when the aforementioned interaction level is obtained, and gives it to the behavior determination mechanism section 32, so that the interaction level can reflect on behavior of the pet robot 1.

Thereby, even if the pet robot 1 has an awakening level lower than the predetermined threshold value, when the value obtained by adding the interaction level to the awakening level becomes higher than the threshold value, the pet robot 1 starts and stands up so as to communicate with the user.

On the contrary, if the value obtained by adding the interaction level to the awakening level becomes lower than the threshold value, the pet robot 1 is shut down. In the case, the pet robot 1 detects time corresponding to the time slot where a value which is obtained by adding the interaction level to the awakening level becomes higher than the threshold value, by referring to the awakening parameter table stored in the memory 10A, and performs various settings so that the pet robot 1 restarts at that time.

As described above, the pet robot 1 starts when the value obtained by adding the interaction level to the awakening level becomes higher than a predetermined threshold value, while it shuts down when the value obtained by adding the interaction level to the awakening level becomes lower than a predetermined threshold value, thereby it can wake up and sleep naturally according to the awakening level and further, even the awakening level is low, the interactive level is increased by the user's spurs, which wakes the pet robot 1 up, and therefore, the pet robot 1 can sleep and wake up more naturally.

Further, the behavior determination mechanism section 32 increases transition probability for making a transition to an active node when the interaction level is high, while it increases transition probability for making a transition to an inactive node when the interaction level is low, thus making it possible to change activity of behavior according to the interaction level.

As a result, when a node is selected from the state transition table 50, the behavior determination mechanism section 32 selects behavior such as dancing, singing or big performance which a user should see, at high probability when the interaction level is high, while selecting behavior such as awakening, exploring or playing with an object which a user may not see, at high probability when the interaction level is low.

At this point, in the case where the interaction level becomes lower than a threshold value, the behavior determination mechanism section 32 is to save consumption energy by turning the power of unnecessary actuators 21, decreasing gains of the actuators 21 or lying down, for example, and further, is to reduce the controller's 10 loads by stopping the audio recognition function.

(3) Operation and Effects of the Present Embodiment

The controller 10 of the pet robot 1 creates the awakening parameter table indicating the awakening level of the pet robot 1 for each time zone in a day, by starting and shutting down repeatedly, and stores it in the memory 10A.

Then, the controller 10 refers to the awakening parameter table, and shuts down when the awakening level is lower than a predetermined threshold value and at this point, sets a timer for the time when the awakening level becomes higher next, to restart, so that the life rhythm of the pet robot 1 can be adapted to the life rhythm of a user. Thus the user can communicate more easily and get a larger sense of affinity.

When the user makes a spur, the controller 10 calculates the interaction level indicating the frequency of spurs, and adds the interaction level to corresponding awakening level in the awakening parameter table. Thereby, even in the case where the awakening level is lower than a predetermined threshold value, the controller 10 starts and stands up when the total of the awakening level and the interactive level becomes higher than the threshold value and as a result, communication can be performed with a user and the user can get a larger sense of affinity.

According to the aforementioned operation, the pet robot 1 can start and shut down according to the history of use of the pet robot 1 by a user, thus making it possible to adapt the life rhythm of the pet robot 1 to the life rhythm of the user, so that the user can get a larger sense of affinity and entertainment property can be improved.

(4) Other Embodiments

Figure 12:
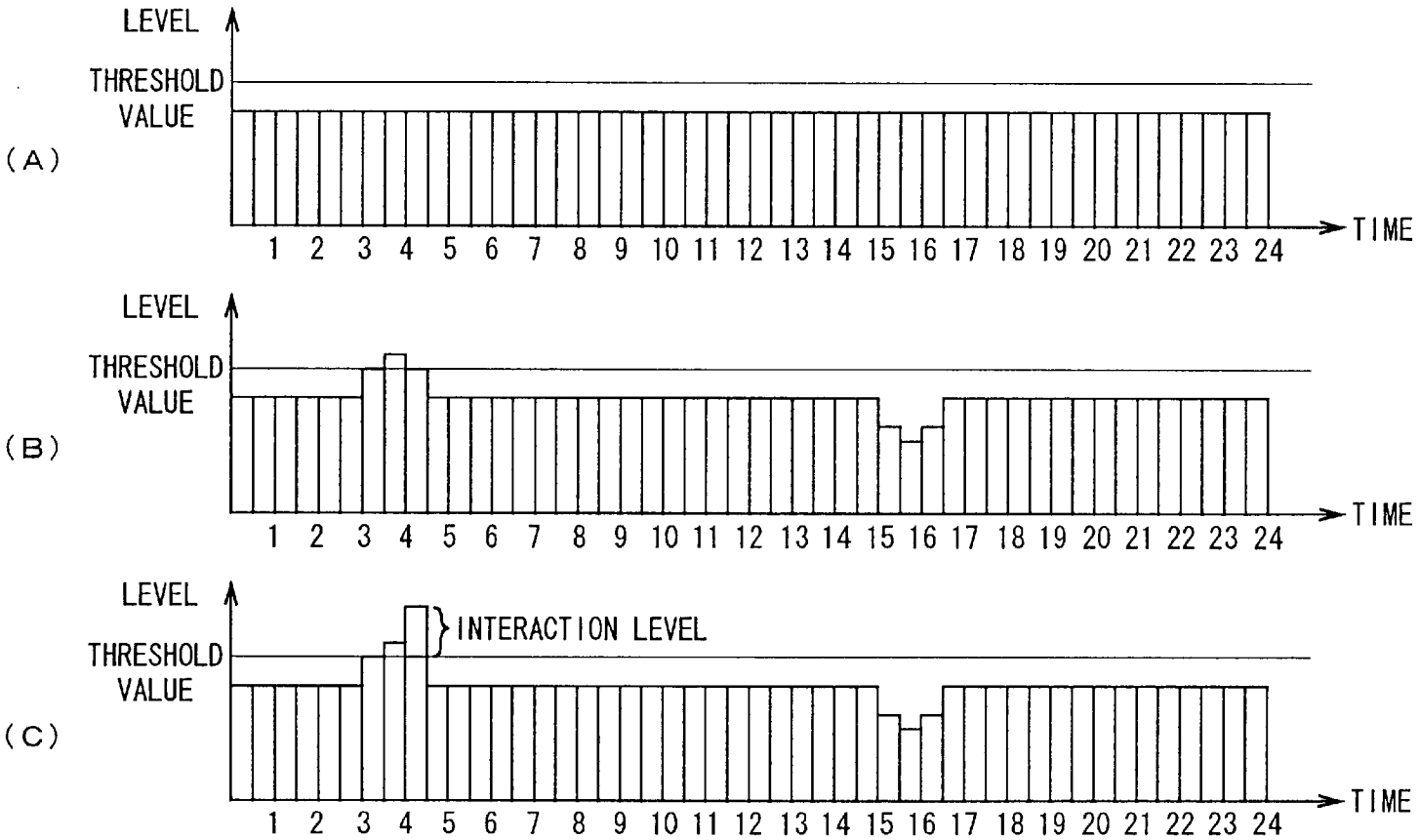
FIG. 12 shows schematic diagrams explaining awakening parameter tables according another embodiment.

Note that, in the aforementioned embodiment, the total Δ awk of the added awakening levels is equally divided and subtracted from all awakening levels of time slots other than the increased time slots. This present invention, however, is not limited to this and as shown in FIG. 12, the awakening levels of time slots after a predetermined time may be partly reduced for the increased time slots.

Further, in the aforementioned embodiment, the threshold value which is a standard of start or shut-down is selected to be a lower value than the initial value of the awakening level awk. The present invention is not limited to this and as shown in FIG. 12, another value can be selected to be a higher value than the initial value of awakening level awk.

Further, in the aforementioned embodiment, the pet robot 1 starts and shuts down based on the awakening parameter table which changes according to the history of use of the pet robot 1 by a user. The present invention, however, is not limited to this and a fixed awakening parameter table which is created based on the age and characters of the pet robot 1 may be utilized.

Furthermore, in the aforementioned embodiment, the time-passage-based averaging method is applied to the calculation method of interaction levels. This present invention, however, is not limited to this and another method may be applied, such as a time-passage-based average weighting method or a time-based subtracting method.

In the weighting method by time-passage-based average, with the present time as a basis, higher weighting coefficients are selected for newer inputs, while lower weighting coefficients are selected for older inputs. For example, with the present time as a basis, the weighting coefficients are set: 10 for inputs before 2 minutes or less; 5 for inputs between 5 minutes before and 2 minutes before; and 1 for inputs between 10 minutes before and 5 minutes before.

Then, the emotion/instinct model section 31 multiplies points of each spur which exists from time which is a predetermined time before the present time to the present time, by the corresponding weighting coefficient, and calculates the total to obtain the interaction level.

In addition, the time-based subtracting method is for obtaining an interaction level by using a variable called an internal interaction level. In this case, when a user makes a spur, the emotion/instinct model section 31 adds points corresponding to the kind of spur to the internal interaction level. At the same time, the emotion/instinct model section 31 decreases the internal interaction level as time passes, by, for example, multiplying the previous internal interaction level by 0.1 every time when one minute passes.

Then, when the internal interaction level becomes lower than a predetermined threshold value, the emotion/instinct model section 31 takes the internal interaction level to as the aforementioned interaction level, while it takes the threshold value to as the interaction level when the internal interaction level becomes higher than the threshold value.

Back to the aforementioned embodiment, a combination of the awakening parameter table and the interaction level is applied to the history of use. This present invention, however, is not limited to this and another kind of history of use which indicates a history of user use in a temporal axis direction may be applied.

Furthermore, in the aforementioned embodiment, the memory 10A is utilized as a storage medium. This present invention, however, is not limited to this and the history of user use may be stored in another kind of storage medium.

Furthermore, in the aforementioned embodiment, the controller 10 is utilized as a behavior determination means. The present invention is not limited to this and another kind of behavior determination means can be utilized to determine next behavior according to the history of use.

Furthermore, the aforementioned embodiment is applied to a four-legged walking robot which is constructed as shown in FIG. 1. This present invention, however, is not limited to this and may be applied to another kind of robot.

Industrial Utilization

The present invention can be applied to a pet robot, for example.

What is claimed is:

1. A robot apparatus comprising:

storage means for storing a history of use which is created in a time axis direction to indicate a history of user use; and behavior determination means for determining next behavior according to said history of use.

2. A robot apparatus comprising:

storage means for storing a history of use which is created in a time axis direction to indicate a history of user use; and behavior determination means for determining next behavior according to said history of use, wherein said history of use is created by changing in the time axis direction an active level indicating how much said robot apparatus was active in the past; and said behavior determination means compares the active level to a present predetermined threshold value, and starts said robot apparatus when the active level becomes higher than the threshold value, while shutting down said robot apparatus when the active level becomes lower than the threshold value.

3. The robot apparatus according to claim 2, wherein:

said history of use is created by changing in the time axis direction an increased level which is obtained by adding a spur level which is determined depending on the frequency of spurs by the user, to the active level; and said behavior determination means compares the increased level to the present predetermined threshold value, and starts said robot apparatus when said increased level becomes higher than the threshold value, while shutting down said robot apparatus when the increased level becomes lower than the threshold value.

4. A control method for a robot apparatus, comprising:

a first step of storing a history of use which is created in a time axis direction to indicate a history of user use;

a second step of determining a next action according to said history of use.

5. A control method for a robot apparatus, said method comprising:

a first step of storing a history of use which is created in a time axis direction to indicate a history of user use;

a second step of determining a next action according to said history of use, wherein said history of use is created by changing in a time axis direction an active level indicating how much said robot apparatus was active in the past; and said second step is to compare the active level to a present predetermined threshold value, and to start said robot apparatus when the active level becomes higher than the threshold value, while shutting down said robot apparatus when the active level becomes lower than the threshold value.

6. The control method for the robot apparatus according to claim 5, wherein:

said history of use is created by changing in the time axis direction an increased level which is obtained by adding a spur level determined depending on the frequency of spurs by the user, to the active level; and said second step is to compare the increased level to a preset predetermined threshold value, and to start said robot apparatus when said increased level becomes higher than the threshold value, while shutting down said robot apparatus when the increased level becomes lower than the threshold value.

7. A robot apparatus which autonomously behaves, comprising:

action control means for driving each part of said robot apparatus;

behavior determination mechanism section for determining behavior of said robot apparatus; and storage means which stores cycle parameters which allow behavior determined by said behavior determination mechanism section to have a cyclic tendency within a predetermined time period; and wherein said behavior determination mechanism section determines behavior based on said cycle parameters; and said action control means drives each part of said robot apparatus based on said behavior determined.

8. The robot apparatus according to claim 7, wherein said cycle parameter is an awakening level parameter.

9. The robot apparatus according to claim 8, wherein the sum of said awakening level parameters is fixed.

10. The robot apparatus according to claim 8, wherein said predetermined time period is approximately 24 hours.

11. The robot apparatus according to claim 8, comprising emotion models which make pseudo emotions of said robot apparatus; and wherein said emotion models are changed based on said awakening level parameters.

12. The robot apparatus according to claim 11, comprising:

external stimulus detecting means for detecting a stimulus from outside;

external stimulus judging means for evaluating said external stimulus detected, judging whether it was from a user, and converting said external stimulus into a predetermined numerical parameter for each spur from the user; and wherein said emotion models are changed based on said predetermined parameters and said awakening level parameters.

13. The robot apparatus according to claim 12, wherein said predetermined parameter is an interaction level.

14. The robot apparatus according to claim 7, comprising:

external stimulus detecting means for detecting a stimulus from outside; and external stimulus judging means for evaluating said external stimulus detected, judging whether it was from a user, and converting said external stimulus into a predetermined numerical parameter for each spur from the user, and wherein said behavior determination mechanism section determines behavior based on said predetermined parameter and said awakening level parameter.

15. The robot apparatus according to claim 14, wherein said predetermined parameter is an interaction level.

16. A control method for a robot apparatus which autonomously behaves, comprising:

a first step of determining behavior of said robot apparatus based on cycle parameters which allow behavior of the robot apparatus to have a cyclic tendency within a predetermined time period; and a second step of driving each part of said robot apparatus based on said determined behavior.

17. The control method for the robot apparatus according to claim 16, wherein said cycle parameter is an awakening level parameter.

18. The control method for the robot apparatus according to claim 17, wherein the sum of said awakening level parameters is fixed.

19. The control method for the robot apparatus according to claim 17, wherein said predetermined time period is approximately 24 hours.

20. The control method for robot apparatus according to claim 17, wherein said first step is to determine said behavior of said robot apparatus based on said cycle parameters and emotion models, while changing the emotion models which determine pseudo emotions of said robot apparatus based on said awakening level parameters.

21. The control method for the robot apparatus according to claim 20, wherein said first step is to evaluate an external stimulus detected by a prescribed external stimulus detecting means and judge whether it was from a user, to convert said external stimulus into a prescribed numerical parameter for each spur from said user, and to change said emotion models based on said prescribed parameters and said awakening level parameters.

22. The control method for the robot apparatus according to claim 21, wherein said prescribed parameter is an interaction level.

23. The control method for the robot apparatus according to claim 17, wherein said first step is to evaluate an external stimulus detected by a predetermined external stimulus detecting means and judge whether it was from a user, and at the same time, while converting said external stimulus into a predetermined numerical parameter for each spur from the user, to determine behavior of said robot apparatus based on predetermined parameter and said awakening level parameter.

24. The control method for the robot apparatus according to claim 23, wherein said predetermined parameter is an interaction level.

25. A robot apparatus which autonomously behaves, comprising:

action control means for driving each part of said robot apparatus;

a behavior determination mechanism section for determining behavior of said robot;

external stimulus detecting means for detecting a stimulus outside; and external stimulus judging means for evaluating the external stimulus detected and judging whether it was from a user, and for converting the external stimulus into a prescribed numerical parameter for each spur from the user; and wherein said behavior determination mechanism section determines behavior based on said prescribed parameter; and said behavior control means drives each part of said robot apparatus based on said determined behavior.

26. The robot apparatus according to claim 25, wherein said prescribed parameter is an interaction level.

27. The robot apparatus according to claim 26, comprising emotion models which determine pseudo emotions of said robot apparatus, and wherein said emotion models are changed based on said interaction levels.

28. A control method for a robot apparatus which autonomously behaves, comprising:

a first step of evaluating an external stimulus detected by a prescribed external stimulus detecting means and judging whether it was from a user, and of converting said external stimulus into a prescribed numerical parameter for each spur from the user, and a second step of determining behavior based on said prescribed parameter and driving each part of said robot apparatus based on said determined behavior.

29. The control method for the robot apparatus according to claim 28, wherein said prescribed parameter is an interaction level.

30. The control method for the robot apparatus according to claim 29, wherein the emotion models which determine pseudo emotions of said robot apparatus are changed based on said interaction levels.

* * * * *